US012674242B2

(12) United States Patent
Kusakari

(10) Patent No.: US 12,674,242 B2
(45) Date of Patent: Jul. 7, 2026

(54) WATER ELECTROLYSIS APPARATUS

(71) Applicant: TOYOTA JIDOSHA KABUSHIKI KAISHA, Toyota (JP)

(72) Inventor: Toshiaki Kusakari, Shizuoka-ken (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 503 days.

(21) Appl. No.: 18/484,936

(22) Filed: Oct. 11, 2023

(65) Prior Publication Data

US 2024/0200215 A1 Jun. 20, 2024

(30) Foreign Application Priority Data

Dec. 20, 2022 (JP) ..... 2022-203061

(51) Int. Cl.

| | |
|---|---|
| ***C25B 15/029*** | (2021.01) |
| ***C25B 1/04*** | (2021.01) |
| ***C25B 9/77*** | (2021.01) |
| ***C25B 15/08*** | (2006.01) |

(52) U.S. Cl.

CPC ..... *C25B 15/08* (2013.01); *C25B 1/04* (2013.01); *C25B 9/77* (2021.01); *C25B 15/029* (2021.01)

(58) Field of Classification Search

None

See application file for complete search history.

(56) References Cited

U.S. PATENT DOCUMENTS

| | | | | |
|---|---|---|---|---|
| 2012/0048731 | A1* | 3/2012 | Haryu | C25B 1/04 204/265 |
| 2018/0202053 | A1 | 7/2018 | Harano et al. | |
| 2022/0311027 | A1 | 9/2022 | Mohri | |

FOREIGN PATENT DOCUMENTS

| | | | |
|---|---|---|---|
| JP | 2012-052208 | A | 3/2012 |
| JP | 2022-153049 | A | 10/2022 |
| WO | 2017/056277 | A1 | 4/2017 |

* cited by examiner

*Primary Examiner* — Luan V Van

(74) *Attorney, Agent, or Firm* — SoraIP, Inc.

(57) ABSTRACT

A water electrolysis apparatus for obtaining hydrogen by electrolyzing water with a water electrolysis cell includes a water electrolysis stack having a plurality of water electrolysis cells, a water supply side path which is a path for supplying water to the water electrolysis stack, and a hydrogen side path through which hydrogen generated in the water electrolysis stack flows, and a gas-liquid separator for gas-liquid separation of a fluid containing oxygen and water discharged from the water electrolysis stack is provided in the water supply side path, and a dilution gas mixer for mixing a dilution gas between the water electrolysis stack and the gas-liquid separator is provided.

3 Claims, 3 Drawing Sheets

WATER ELECTROLYSIS APPARATUS

CROSS-REFERENCE TO RELATED APPLICATION

This application claims priority to Japanese Patent Application No. 2022-203061 filed on Dec. 20, 2022, incorporated herein by reference in its entirety.

BACKGROUND

1. Technical Field

The present disclosure relates to a water electrolysis apparatus.

2. Description of Related Art

Japanese Unexamined Patent Application Publication No. 2012-052208 (JP 2012-052208 A) discloses supplying dilution air to a gas-liquid separator for separating water and oxygen in a water electrolysis apparatus in order to dilute mixed hydrogen.

SUMMARY

Even if dilution air is supplied to the gas-liquid separator, there is a possibility that a hydrogen distribution is generated and a portion where hydrogen is not locally diluted is generated.

An object of the present disclosure is to provide a water electrolysis apparatus capable of efficiently diluting hydrogen mixed in a water supply side path while suppressing deviation in concentration distribution.

The present application discloses a water electrolysis apparatus that obtains hydrogen by water electrolysis using a water electrolysis cell, and the water electrolysis apparatus includes: a water electrolysis stack including a plurality of the water electrolysis cells; a water supply side path that is a path through which water is supplied to the water electrolysis stack; and a hydrogen side path through which hydrogen generated in the water electrolysis stack flows.

The water supply side path is provided with a gas-liquid separator that separates gas and liquid of a fluid containing oxygen and water discharged from the water electrolysis stack, and a dilution gas mixer that mixes a dilution gas between the water electrolysis stack and the gas-liquid separator is provided.

In the water electrolysis apparatus, a hydrogen concentration meter may be provided in a flow path through which gas separated by the gas-liquid separator is discharged from the gas-liquid separator, and the water electrolysis apparatus may include a controller that controls an operation of the water electrolysis apparatus.

The controller may be configured to mix the dilution gas from the dilution gas mixer when a value obtained using the hydrogen concentration meter exceeds a predetermined threshold value.

The dilution gas may be air.

According to the present disclosure, since the diluent gas is mixed into the fluid before reaching the gas-liquid separator, the diluent gas is more uniformly mixed into the fluid, so that the concentration distribution of hydrogen contained in the fluid is less likely to be biased.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

1. Configuration of Water Electrolysis Apparatus

Figure 1:
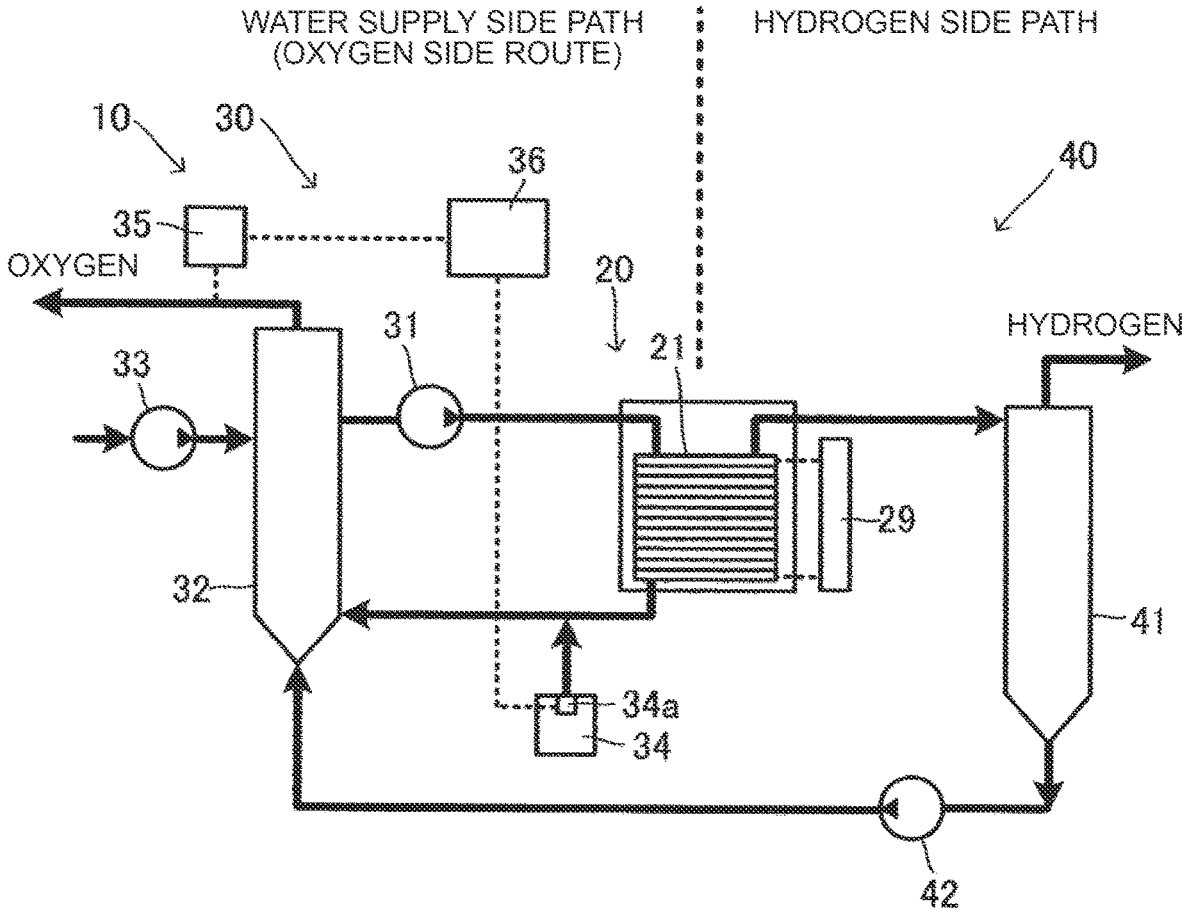
FIG. 1 is a conceptual diagram illustrating a configuration of a water electrolysis apparatus.

FIG. 1 conceptually illustrates a water electrolysis apparatus 10 according to one embodiment.

In this embodiment, the water electrolysis apparatus 10 includes a water electrolysis stack 20, a water supply side path (oxygen side path) 30, and a hydrogen side path 40. In the water electrolysis apparatus 10, water is supplied from the water supply side path 30 to the water electrolysis cell 21 provided in the water electrolysis stack 20 and is energized to decompose the water into hydrogen and oxygen, thereby obtaining hydrogen and separating the hydrogen into the hydrogen side path 40.

1.1. Water Electrolysis Stack and Water Electrolysis Cell

Figure 2:
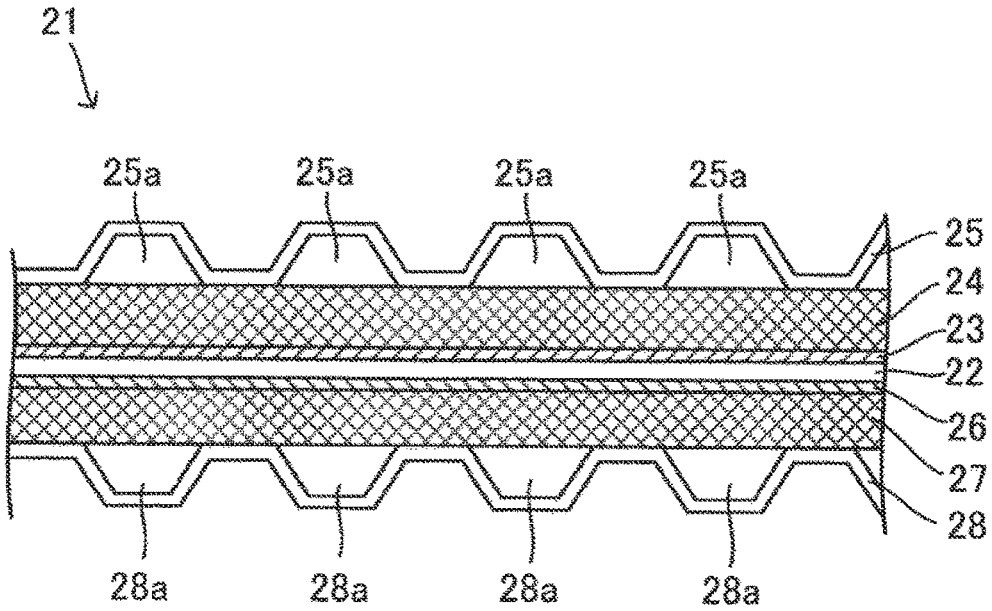
FIG. 2 is a conceptual diagram illustrating a configuration of a water electrolysis cell.

FIG. 2 conceptually shows the form of the water electrolysis cell 21. The water electrolysis cell 21 is a unit element for decomposing water into hydrogen and oxygen, and a plurality of such water electrolysis cells 21 are stacked and arranged in the water electrolysis stack 20.

Although the water electrolysis cell 21 is known in the art, in the present embodiment, a plurality of layers are formed, one of which is an oxygen generating electrode (anode) and the other is a hydrogen generating electrode (cathode) across the solid polymer electrolyte membrane 22.

The material constituting the solid polymer electrolyte membrane 22 is a solid polymer material, and examples thereof include a proton-conductive ion exchange membrane formed of a fluorine-based resin, a hydrocarbon-based resin material, or the like. This shows good proton conductivity (electrical conductivity) in the wet state. More specifically, Nafion (registered trademark) which is a perfluorosulfonic acid membrane is exemplified.

The oxygen generating electrode (anode) is provided with an oxygen electrode catalyst layer 23, an oxygen electrode gas diffusion layer 24, and an oxygen electrode separator 25 in this order from the solid polymer electrolyte membrane 22 side. The oxygen electrode catalyst layer 23 is a layer composed of a noble metal catalyst such as Pt, Ru, Ir and an electrode catalyst containing at least one oxide thereof.

The oxygen electrode gas diffusion layer 24 is formed of a gas permeable and conductive member. Specifically, a porous conductive member made of metal fibers, metal particles, or the like can be exemplified.

The oxygen electrode separator 25 includes a flow path 25*a* through which water to be supplied to the oxygen electrode gas diffusion layer 24, generated oxygen, and excess water flow.

The hydrogen generating electrode (cathode) is provided on a surface of the surface of the solid polymer electrolyte membrane 22 opposite to the surface on which the oxygen generating electrode is disposed, and includes a hydrogen electrode catalyst layer 26, a hydrogen electrode gas diffusion layer 27, and a hydrogen electrode separator 28 in this order from the side of the solid polymer electrolyte membrane 22.

The hydrogen electrode catalyst layer 26 may include, for example, a layer containing Pt or the like.

The hydrogen electrode gas diffusion layer 27 is formed of a member having gas permeability and conductivity. Specific examples thereof include porous members such as carbon cloth and carbon paper.

The hydrogen electrode separator 28 is a member including a flow path 28*a* through which the generated hydrogen and water associated therewith flow.

The water ($H_2O$) supplied from the flow path 25*a* of the oxygen electrode separator 25 to the oxygen generating electrode is supplied by the power supply 29 between the oxygen generating electrode and the hydrogen generating electrode, and is decomposed into oxygen, electrons, and protons ($H^+$) in the oxygen electrode catalyst layer 23 having a potential applied thereto. At this time, the protons migrate through the solid polymer electrolyte membrane 22 to the hydrogen electrode catalyst layer 26. On the other hand, the electrons separated by the oxygen electrode catalyst layer 23 pass through an external circuit and reach the hydrogen electrode catalyst layer 26. Then, protons receive electrons in the hydrogen electrode catalyst layer 26, and hydrogen is generated. The generated hydrogen and the accompanying water reach the hydrogen electrode separator 28, is discharged from the flow path 28*a*, and moves to the hydrogen side path 40. The oxygen and excess water separated in the oxygen electrode catalyst layer 23 reach the oxygen electrode separator 25, are discharged from the flow path 25*a*, and move to the water supply side path 30.

1.2. Water Supply Side Route (Oxygen Side Route)

The water supply side path (oxygen side path) 30 is a path including a pipe for supplying water to the water electrolysis cell 21 of the water electrolysis stack 20 to obtain oxygen. In the present embodiment, water is supplied to the water electrolysis stack 20 by the pump 31 in the water supply side path 30. If necessary, a cooler for cooling water or an ion exchanger for removing ions contained in water may be disposed between the pump 31 and the water electrolysis stack 20.

In the water supply side path 30, the oxygen generated in the water electrolysis stack 20 and the unused water are discharged from the water electrolysis stack 20 and supplied to the gas-liquid separator 32. In the gas-liquid separator 32, water and oxygen are separated, the separated oxygen is discharged, and the water is supplied to the pump 31 again. The insufficient water is supplied from the pump 33 to the gas-liquid separator 32.

The above-described devices are connected by pipes to form a fluid path. The water supply side path 30 of the present embodiment further includes a dilution gas mixer 34, a hydrogen concentration meter 35, and a controller 36.

1.2.1. Dilution Gas Mixer

The dilution gas mixer 34 is a means for mixing the dilution gas into a pipe between the water electrolysis stack 20 and the gas-liquid separator 32 in the water supply side path 30. The dilution gas is a gas for diluting the hydrogen in view of the fact that the fluid containing water and oxygen discharged from the water electrolysis stack 20 may further contain hydrogen gas. Examples of the dilution gas include an inert gas such as air and nitrogen.

By mixing the dilution gas into the fluid before reaching the gas-liquid separator 32 in the piping in this way, it is possible to more evenly mix the dilution gas into the fluid, and it becomes difficult to cause a deviation in the concentration distribution of hydrogen.

Although there is no particular limitation on the specific device configuration in which the dilution gas is mixed, the dilution gas (e.g., compressed air, compressed nitrogen, or the like) having an increased pressure may be injected into the pipe. Specific mixing of the dilution gas will be described later. In this embodiment, in order to control the permission and prohibition of the mixing of the dilution gas, the dilution gas mixer 34 is provided with a valve 34*a*, and the controller 36 can operate the valve.

1.2.2. Hydrogen Concentration Meter

In the present embodiment, a hydrogen concentration meter 35 for measuring the hydrogen concentration in the gas flowing in the pipe with respect to the pipe for discharging the gas from the gas-liquid separator 32 is arranged in the water supply side path. Although the specific mode of the hydrogen concentration meter 35 is not particularly limited and is known in the art, it is preferable that the measured hydrogen concentration be transmitted to the controller 36 as data.

1.2.3. Controller

Figure 3:
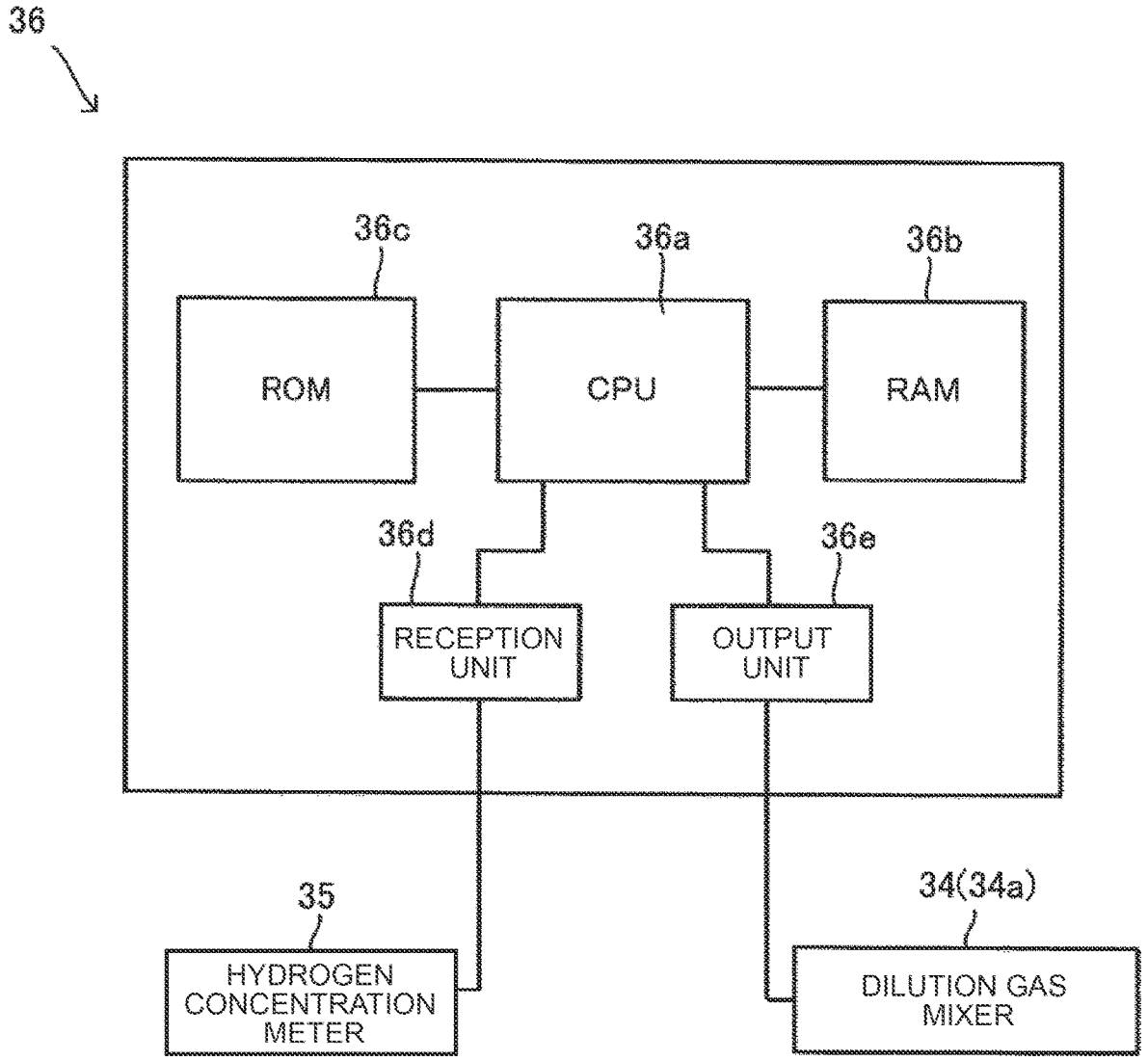
FIG. 3 is a conceptual diagram of a computer (controller)

The controller 36 is a controller that controls the water electrolysis apparatus 10 of the present disclosure. The embodiment of the controller 36 is not particularly limited, but may typically be configured by a computer. FIG. 3 conceptually illustrates a configuration example of the computer 36 as the controller 36.

The computer 36 includes a Central Processing Unit (CPU) 36*a* that is a processor, a Random Access Memory (RAM) 36*b* that functions as a working area, a Read-Only Memory (ROM) 36*c* as a storage medium, a reception unit 36*d* that is an interface that accepts information regardless of whether it is wired or wireless to the computer 36, and an output unit 36*e* that is an interface that sends information regardless of whether it is wired or wireless from the computer 36 to the outside.

A hydrogen concentration meter 35 provided in the water supply side path 30 is communicably connected to the reception unit 36*d* so that the hydrogen concentration can be received as a signal.

On the other hand, a dilution gas mixer 34 (valve 34*a*) is communicably connected to the output unit 36*e*.

The computer 36 stores a computer program for executing each process for control performed by the water electrolysis apparatus 10 of the present disclosure as a specific command. In the computer 36, a CPU 36*a*, RAM 36*b* and a ROM 36*c* as hardware resources and a computer program cooperate with each other. Specifically, CPU 36*a* executes the computer program recorded in ROM 36*c* in a RAM 36*b* functioning as a working area on the basis of the signal from the hydrogen concentration meter acquired via the reception unit 36*d*, thereby realizing the function. The data acquired or generated by CPU 36*a* is stored in RAM 36*b*. Then, a command is transmitted to the dilution gas mixer 34 (valve 34*a*) via the output unit 36*e* as needed based on the obtained result. Details of control by the water electrolysis apparatus 10 of the present disclosure will be described later.

1.3. Hydrogen Side Pathway

The hydrogen side path 40 is a path including a pipe for taking out the hydrogen separated by the water electrolysis stack 20. In the hydrogen side path 40, hydrogen and water discharged from the water electrolysis cell 21 of the water electrolysis stack 20 are supplied to the gas-liquid separator 41. In the gas-liquid separator 41, water and hydrogen are separated. The hydrogen separated by the gas-liquid separator 41 is collected, dehumidified, or the like, and stored in a tank. The water separated by the gas-liquid separator 41 is sent to the gas-liquid separator 32 of the water supply side path 30 by the pump 42 and is used again. These devices are connected by pipes.

2. Control of Water Electrolysis Apparatus

As described above, in the water electrolysis apparatus 10 of the present embodiment, the dilution gas is mixed into the pipe between the gas-liquid separator 32 from the water electrolysis stack 20 in the water supply side path 30 by the dilution gas mixer 34. Here, the control of the mixing of the dilution gas will be described.

2.1. Form Example 1

In the first embodiment, the dilution gas is unconditionally mixed with the dilution gas from the dilution gas mixer 34 while the water electrolysis apparatus 10 is in operation. In this embodiment, when the operation of the water electrolysis apparatus 10 is started, the valve 34*a* is opened to supply the dilution gas, and when the water electrolysis apparatus 10 is stopped, the valve 34*a* is closed to stop the supply of the dilution gas. In this case, the opening and closing of the valve 34*a* may be controlled in response to an operation command from the controller 36, or may be interlocked with the operation of the pump 31.

2.2. Form Example 2

Figure 4:
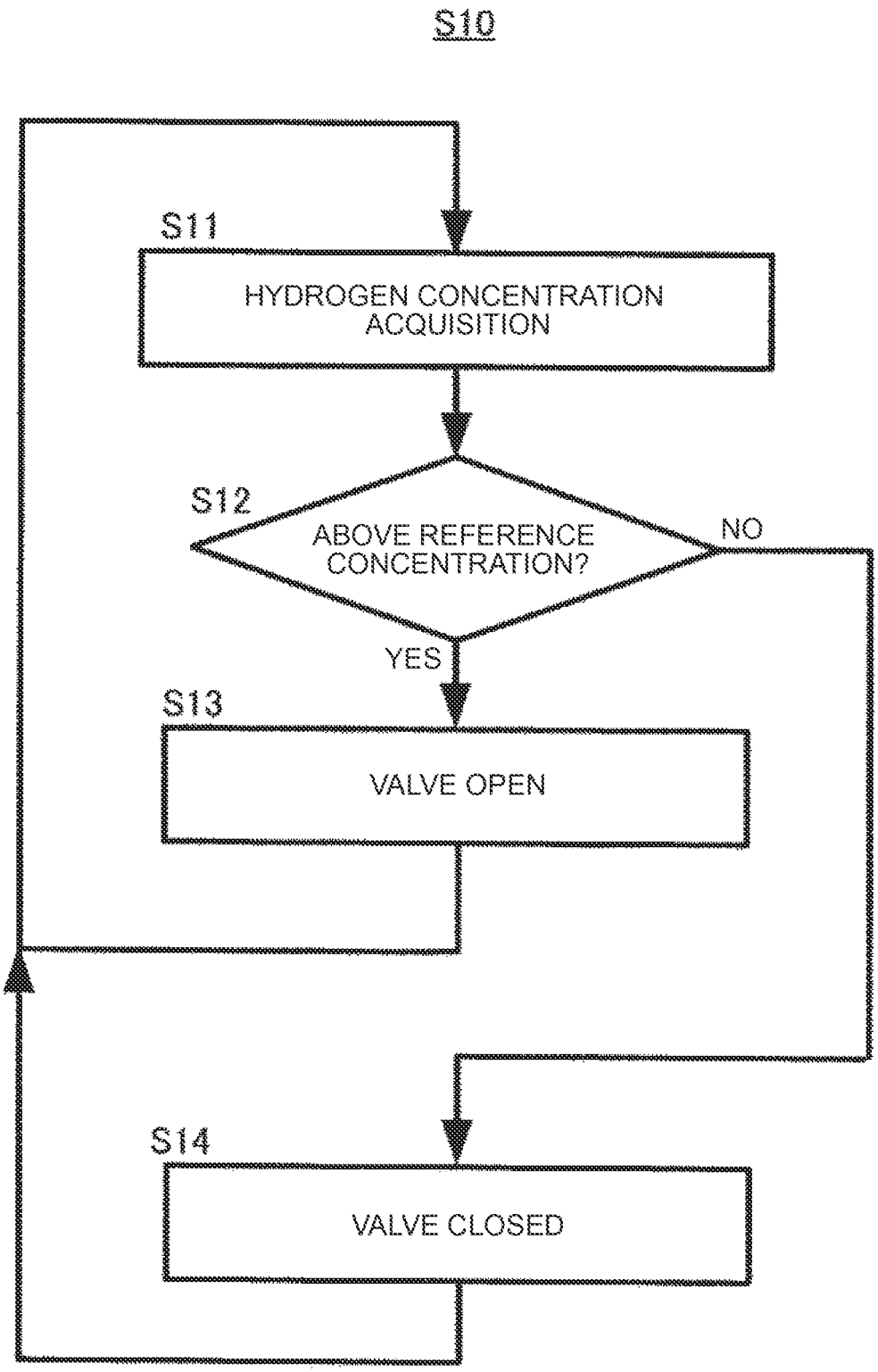
FIG. 4 is a diagram illustrating a flow of a control S10 of the water electrolysis apparatus.

FIG. 4 shows a flow of a control S10 (hereinafter, sometimes referred to as "control S10") of the water electrolysis apparatus according to Embodiment 2. As can be seen from FIG. 4, the control S10 includes process S14 from process S11. In the present embodiment, the computer program stored in the controller 36 is configured to be a command to a specific computer for executing the respective processes of the control S10.

2.2.1. Process S11

In the process S11, the controller 36 acquires the hydrogen concentration from the hydrogen concentration meter 35. Thus, the concentration of hydrogen contained in the exhaust gas from the gas-liquid separator 32 is obtained.

2.2.2. Process S12

In the process S12, it is determined whether the hydrogen concentration obtained by the process S11 is equal to or higher than a predetermined concentration (equal to or higher than a reference concentration). The specific value of the reference concentration is not particularly limited and can be appropriately set.

In the process S12, when the hydrogen concentration obtained by the process S11 is equal to or higher than the reference concentration, Yes is selected and the process S13 is performed. On the other hand, when the concentration is lower than the reference concentration, No is selected to proceed to the process S14.

2.2.3. Process S13

In the process S13, the valve 34*a* is opened when the hydrogen concentration obtained by the process S11 is equal to or higher than the reference concentration. As a result, the dilution gas is mixed in and the hydrogen concentration can be lowered.

Here, the valve opening of the valve 34*a* depends on the type of valve. When the valve 34*a* is a solenoid valve (on-off valve), the valve opens fully, and when the valve 34*a* is a regulating valve, the valve opens so that the required flow rate is achieved. The required flow rate may be performed by checking the relation with the hydrogen-concentration obtained in the process S11 in advance, storing it in the controller 36 as a data base, and adjusting the opening degree of the valve using this.

After the valve is opened in the process S13, the process returns to the process S11.

2.2.4. Process S14

In the process S14, the valve 34*a* is closed when the hydrogen concentration obtained by the process S11 is lower than the reference concentration. When the valve 34*a* is already in the closed state, the closed state is maintained. After the valve was closed by the process S14, it returned to the process S11.

3. Effects

According to the present embodiment, since the dilution gas is mixed into the fluid flowing through the pipe before reaching the gas-liquid separator, the dilution gas is more uniformly mixed into the fluid, so that the concentration distribution of the hydrogen contained in the fluid is hardly biased.

What is claimed is:

1. A water electrolysis apparatus that obtains hydrogen by water electrolysis using a water electrolysis cell, the water electrolysis apparatus comprising:

a water electrolysis stack including a plurality of the water electrolysis cells;

a water supply side path that is a path through which water is supplied to the water electrolysis stack; and a hydrogen side path through which hydrogen generated in the water electrolysis stack flows, wherein:

the water supply side path is provided with a gas-liquid separator that separates gas and liquid of a fluid containing oxygen and water discharged from the water electrolysis stack; and a dilution gas mixer that mixes a dilution gas between the water electrolysis stack and the gas-liquid separator is provided.

2. The water electrolysis apparatus according to claim 1, wherein:

a hydrogen concentration meter is provided in a flow path through which gas separated by the gas-liquid separator is discharged from the gas-liquid separator;

the water electrolysis apparatus includes a controller that controls an operation of the water electrolysis apparatus; and the controller is configured to mix the dilution gas from the dilution gas mixer when a value obtained using the hydrogen concentration meter exceeds a predetermined threshold value.

3. The water electrolysis apparatus according to claim 1, wherein the dilution gas is air.

* * * * *